US009371728B2

(12) United States Patent
Jacob et al.

(10) Patent No.: US 9,371,728 B2
(45) Date of Patent: Jun. 21, 2016

(54) DOWNHOLE PRESSURE COMPENSATOR AND METHOD OF SAME

(75) Inventors: Gregoire Jacob, Houston, TX (US); Alain Nguyen-Thuyet, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 190 days.

(21) Appl. No.: 14/240,403

(22) PCT Filed: Aug. 29, 2012

(86) PCT No.: PCT/US2012/052758

§ 371 (c)(1),
(2), (4) Date: Apr. 15, 2014

(87) PCT Pub. No.: WO2013/033138

PCT Pub. Date: Mar. 7, 2013

(65) Prior Publication Data

US 2014/0284050 A1 Sep. 25, 2014

(30) Foreign Application Priority Data

Aug. 29, 2011 (EP) ..... 11290384

(51) Int. Cl.
*E21B 47/06* (2012.01)
*E21B 47/01* (2012.01)
*E21B 49/00* (2006.01)

(52) U.S. Cl.
CPC ..... *E21B 47/06* (2013.01); *E21B 47/011* (2013.01); *E21B 49/00* (2013.01)

(58) Field of Classification Search
CPC ..... E21B 47/06; E21B 47/011; E21B 49/00
See application file for complete search history.

(56) References Cited

U.S. PATENT DOCUMENTS

| | | | | |
|---|---|---|---|---|
| 6,070,608 | A * | 6/2000 | Pringle | E21B 34/066 137/155 |
| 6,766,703 | B1 | 7/2004 | Kluth et al. | |
| 6,997,258 | B2 | 2/2006 | Homan et al. | |
| 7,062,959 | B2 | 6/2006 | Kurkjian et al. | |
| 7,073,609 | B2 | 7/2006 | Tabanou et al. | |
| 7,242,192 | B2 | 7/2007 | Warntjes | |
| 7,242,194 | B2 | 7/2007 | Hayman et al. | |
| 7,562,580 | B2 | 7/2009 | Rezgui et al. | |
| 7,832,276 | B2 | 11/2010 | Wu et al. | |
| 2010/0147083 | A1 | 6/2010 | Tan et al. | |
| 2011/0253445 | A1* | 10/2011 | Hannegan | E21B 19/09 175/5 |

FOREIGN PATENT DOCUMENTS

WO 01/36928 5/2001

* cited by examiner

*Primary Examiner* — Shane Bomar

(57) ABSTRACT

The techniques herein relate to a pressure compensation system for a sensor in a wellbore having a wellbore fluid therein. The system includes a downhole tool (104) and at least one pressure compensator (112) positionable therein. The pressure compensator includes a first compensating fluid section having a first compensating fluid (238) therein, a first pressure compensation section having a first pressure regulation device (226) for adjusting a compensation pressure of the first compensating fluid based on a wellbore pressure of the wellbore fluid, at least one second compensating fluid section having a second compensating fluid (252) therein, and at least one second pressure compensation section having a second pressure regulation device (246) for adjusting a sensor pressure of the second compensating fluid based on the compensation pressure of the first compensating fluid.

14 Claims, 5 Drawing Sheets

DOWNHOLE PRESSURE COMPENSATOR AND METHOD OF SAME

BACKGROUND

1. Field

This disclosure relates to techniques (e.g., apparatuses, systems and methods) for performing wellsite operations. More particularly, this disclosure relates to techniques for compensating for downhole conditions, such as pressure.

2. Related Art

Oil rigs are positioned at wellsites to locate and gather valuable downhole fluids, such as hydrocarbons. Various oilfield operations are performed at the wellsites, such as drilling a wellbore, performing downhole testing and producing downhole fluids. Downhole drilling tools are advanced into the earth from a surface rig to form a wellbore. Drilling fluids, such as drilling muds, are often pumped into the wellbore as the drilling tool is advanced into the earth. The drilling muds may be used, for example, to remove cuttings, to cool a drill bit at the end of the drilling tool and/or to line a wall of the wellbore.

During wellsite operations, measurements are often taken to determine downhole conditions. In some cases, the drilling tool may be removed so that a downhole tool may be lowered into the wellbore to take additional measurements of the wellbore. The downhole measurements may be taken by drilling, testing, production and/or other tools for determining downhole conditions and/or to assist in locating subsurface reservoirs containing valuable hydrocarbons. Such wellsite tools may be used to measure downhole parameters, such as pressure, temperature, permittivity, resistivity, etc. Such measurements may be useful in directing oilfield operations and/or for analyzing downhole conditions.

Various techniques have been developed for measuring downhole parameters as described, for example, in U.S. Pat. Nos. 7,073,609, 7,062,959 and 7,242,194. As the downhole tool advances into the earth, conditions may become increasingly harsh. In some cases, pressures and/or temperatures may rise to levels that affect the operation of downhole devices, such as sensors. Some techniques have been developed for protecting downhole devices from various downhole conditions as described, for example, in U.S. Pat. Nos. 6,997,258, 7,562,580 and 7,832,276.

Some techniques for protecting sensors may involve providing an interface, such as a bellows or piston between the sensor and wellbore fluids to protect the sensors from the harsh conditions. However, exposure to wellbore fluids may result in damage to the sensors and/or the interface, and/or degraded performance of the sensors.

Despite the advancements in downhole measurement and/or imaging tools, there remains a need for techniques to protect downhole devices from downhole conditions, such as pressure and/or exposure to downhole fluids. This disclosure is direct at providing such protection.

BRIEF SUMMARY

In at least one aspect, the disclosure relates to a pressure compensation system for at least one sensor positionable in a wellbore penetrating a subterranean formation, the wellbore having a wellbore fluid therein. The system includes a downhole tool positionable in the wellbore (the downhole tool having the sensor), and at least one pressure compensator positionable in the downhole tool. The pressure compensator includes a first compensating fluid section having a first compensating fluid therein, a first pressure compensation section in pressure communication with the wellbore fluid and the first compensating fluid section, at least one second compensating fluid section having a second compensating fluid therein, and at least one second pressure compensation section in pressure communication with the first compensating fluid section and the second compensating fluid section.

The first pressure compensation section has a first pressure regulation device separating the wellbore fluid from the first compensating fluid and for adjusting a compensation pressure of the first compensating fluid based on a wellbore pressure of the wellbore fluid. The second compensating fluid is in contact with the sensor. The second pressure compensation section has a second pressure regulation device separating the first compensating fluid from the second compensating fluid and for adjusting a sensor pressure of the second compensating fluid based on the compensation pressure of the first compensating fluid.

The system may also include at least one third compensating fluid section having a third compensating fluid therein (the third compensating fluid is in contact with the sensor), and at least one third pressure compensation section in pressure communication with the wellbore fluid and the third compensating fluid section. The third pressure compensation section has a third pressure regulation device separating the wellbore fluid from the third compensating fluid and for adjusting a sensor pressure of the third compensating fluid based on the wellbore pressure of the wellbore fluid. The first and second pressure regulation devices each includes a piston, a membrane, and/or a bellows. The first pressure regulation device may comprise a spring loaded piston. The system may also include at least one seal for restricting the flow of fluid therethrough. The second pressure compensation section may be fluidly coupled to the first compensating fluid section by a flowline. The first pressure compensation section may be fluidly coupled to the first compensating fluid section by a flowline. The system may also include at least one sensing device for determining a position of the first pressure regulation device, and/or the second pressure regulation device. The system may also include a disconnect for selectively detaching the second pressure compensation section from the first compensating fluid section. The system may also include at least one plug for selectively accessing the first compensating fluid, and/or the second compensating fluid. The compensation pressure of the first compensating fluid may include an overpressure with respect to the wellbore pressure of the wellbore fluid. The sensor pressure of the second compensating fluid may include an overpressure with respect to the compensation pressure of the first compensating fluid. The downhole tool may be a drilling tool, coiled tubing tool, testing tool, measurement while drilling tool, logging while drilling tool, and/or wireline tool.

In another aspect, the disclosure relates to a method of compensating pressure for at least one sensor positionable in a wellbore penetrating a subterranean formation and having a wellbore fluid therein. The method involves deploying a downhole tool into the wellbore. The downhole tool has a pressure compensator operatively connected to the sensor. The pressure compensator includes a first compensating fluid section having a first compensating fluid therein, a first pressure compensation section in pressure communication with the wellbore fluid and the first compensating fluid section, at least one second compensating fluid section having a second compensating fluid therein, and at least one second pressure compensation section in pressure communication with the first compensating fluid section and the second compensating fluid section. The first pressure compensation section has a first pressure regulation device separating the wellbore fluid from the first compensating fluid. The second compensating fluid is in contact with the sensor. The second pressure compensation section has a second pressure regulation device separating the first compensating fluid from the second compensating fluid. The method further involves exposing the sensor to the wellbore pressure by adjusting a compensation pressure of the first compensating fluid based on a wellbore pressure of the wellbore fluid and adjusting a sensor pressure of the second compensating fluid based on the compensation pressure of the first compensating fluid.

The pressure compensator may also include at least one third compensating fluid section having a third compensating fluid therein. The third compensating fluid may be in contact with the sensor, and at least one third pressure compensation section may be in pressure communication with the wellbore fluid and the third compensating fluid section. The third pressure compensation section has a third pressure regulation device separating the wellbore fluid from the third compensating fluid. The method may also involve exposing the sensor to the wellbore pressure by adjusting a sensor pressure of the third compensating fluid based on the wellbore pressure of the wellbore fluid.

BRIEF DESCRIPTION OF THE DRAWINGS

So that the above recited features and advantages of the techniques herein can be understood in detail, a more particular description thereof, briefly summarized above, may be had by reference to the embodiments thereof that are illustrated in the appended drawings. It is to be noted, however, that the appended drawings illustrate only typical embodiments and are, therefore, not to be considered limiting of its scope, for the techniques herein may admit to other equally effective embodiments. The figures are not necessarily to scale, and certain features and certain views of the figures may be shown exaggerated in scale or in schematic in the interest of clarity and conciseness.

DETAILED DESCRIPTION OF THE INVENTION

The description that follows includes exemplary systems, apparatuses, methods, techniques and instruction sequences that embody the present inventive subject matter. However, it is understood that the described embodiments may be practiced without these specific details.

The techniques herein are designed to protect downhole devices (e.g., sensors and/or sensing systems) from exposure to harsh conditions (e.g., high temperature, high pressure and/or corrosive materials), while still enabling measurement of downhole parameters. In some cases, the downhole devices cannot withstand the downhole conditions of a wellbore and/or exposure to wellbore fluids (e.g., drilling or production fluids). In particular, pressure in the wellbore may increase with the drilled depth and increase the risk of damage to downhole devices.

It may be desirable to provide an interface between the wellbore fluids and the downhole devices to transmit pressure without exposing the downhole devices to the wellbore fluids. An additional (or indirect) interface may be provided between the downhole devices and the downhole environment to further isolate the downhole devices from exposure to the harsh downhole conditions in the wellbore. The indirect interface may be used, for example, to limit exposure to wellbore fluids (e.g., to enhance maintenance, reduce cleaning, reduce degradation of the direct interface, reduce clogging, etc.), to provide a compensation media with known properties, to prevent leakage/mud entry, to prevent component damage (e.g., mud entry, seal degradation, membrane perforation, etc.), and/or to provide a single interface with the wellbore fluid for multiple sensors.

Figure 1:
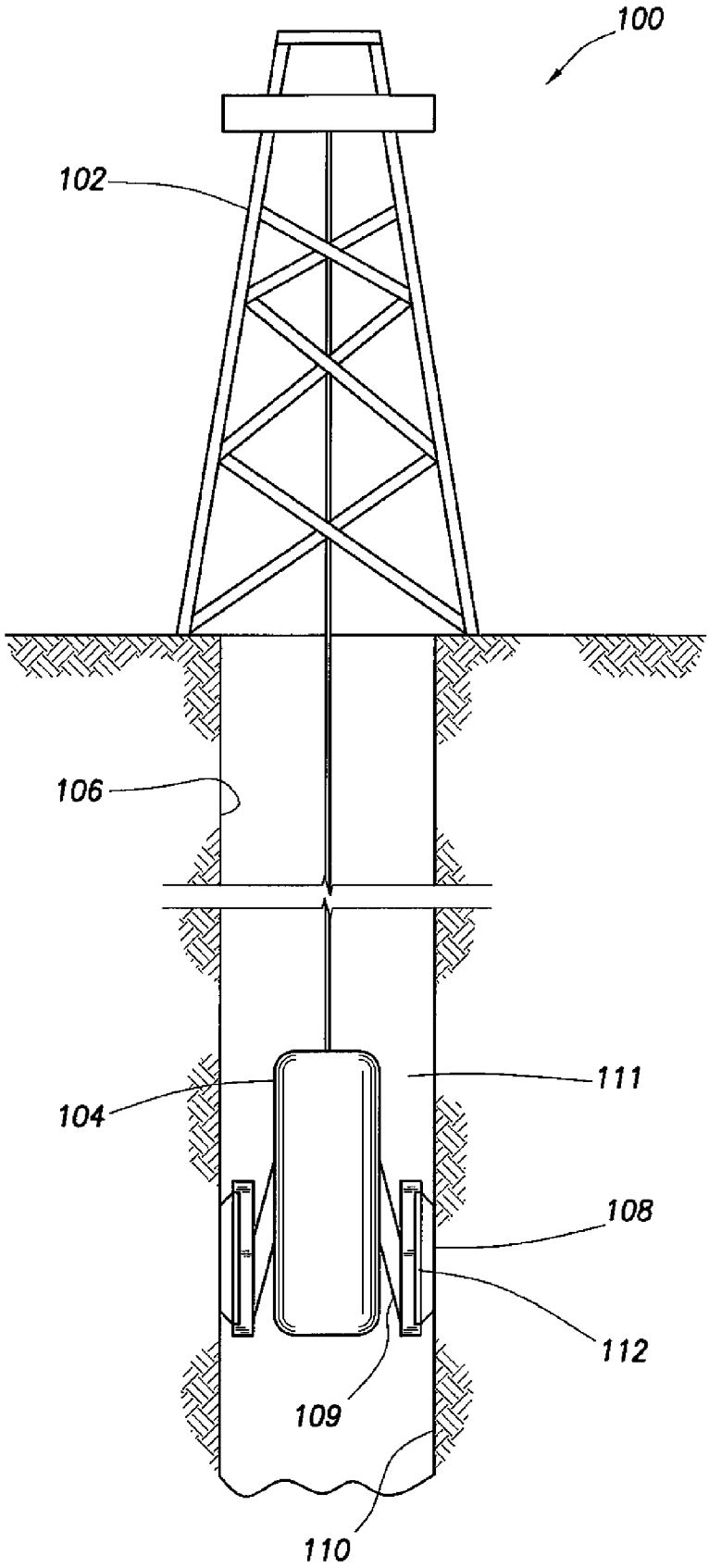
FIG. 1 is a schematic view, partially in cross section, of a wellsite having a downhole tool deployable into a wellbore, the downhole tool having a pressure compensator and a sensing unit therein.

FIG. 1 is a schematic view of a wellsite 100 having a rig 102 with a downhole tool 104 deployed into a wellbore 106. The downhole tool 104 is depicted as having a sensing unit 108 positionable along a wall 110 of the wellbore 106 having a wellbore fluid 111 therein. The sensing unit 108 may be, for example, an imaging sensor for measuring downhole parameters and/or generating downhole images, such as that described in U.S. Pat. No. 7,242,192. The downhole tool 104 also has a pressure compensator 112 usable for protecting the sensing unit 108 during operation. At least a portion of the pressure compensator 112 and/or the sensing unit 108 may be positioned in the downhole tool 104 and/or extendable therefrom via one or more arms 109.

As shown, the downhole tool 104 is a wireline tool positioned in a land based rig, but could be any downhole tool (e.g., drilling, coiled tubing, testing, measurement while drilling, logging while drilling, etc.) deployed from a land based rig or offshore platform. Also, the sensing unit 108 is depicted as being used with a specific type of sensing unit 108, such as an imaging tool positionable in the downhole tool 104, but may be used with any downhole sensor, sensing unit or other downhole device.

Figure 2:
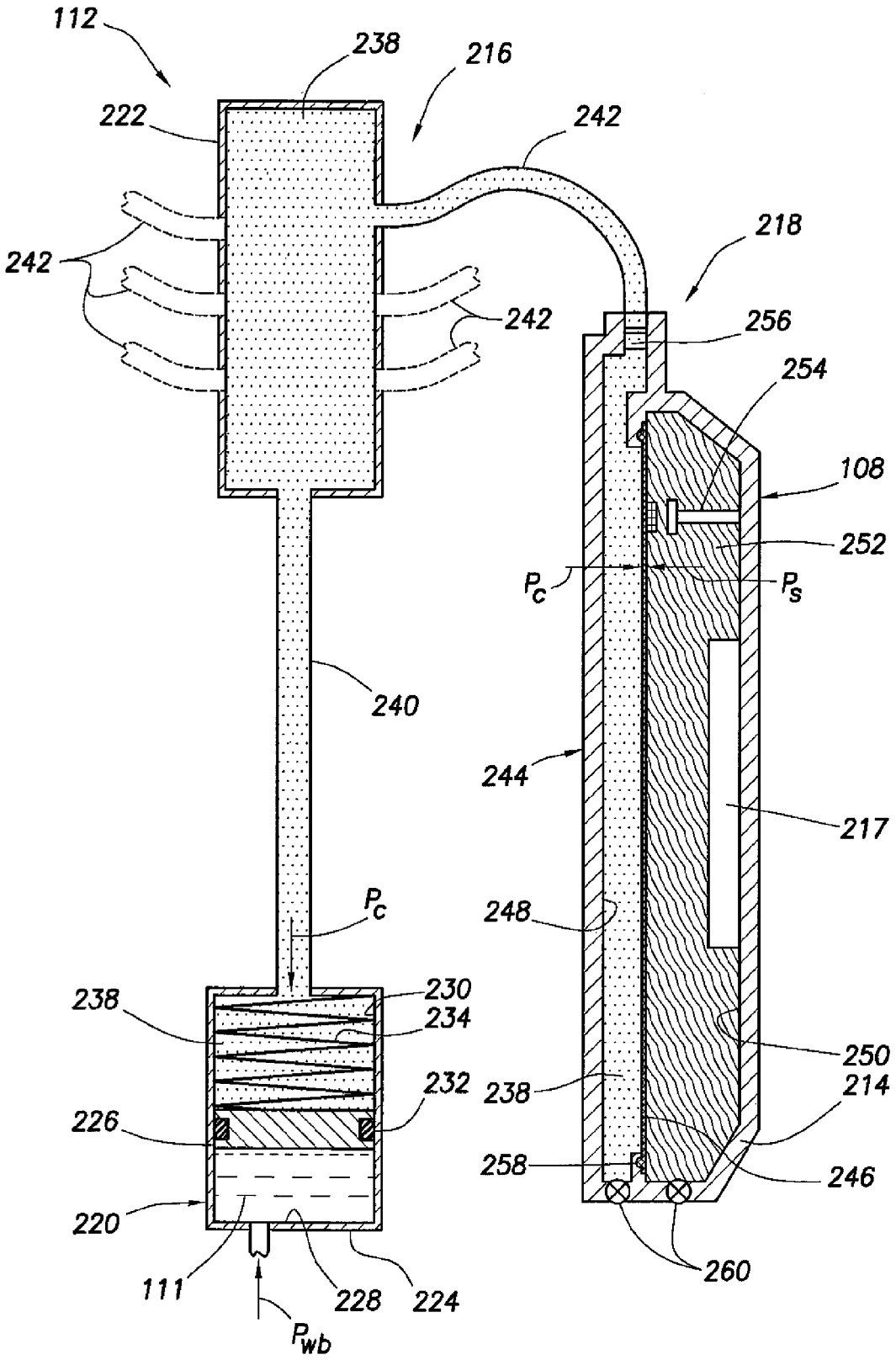
FIG. 2 is a schematic view of a portion of the downhole tool of FIG. 1 depicting the pressure compensator and the sensing unit in greater detail.

FIG. 2 is a schematic view of a portion of the downhole tool of FIG. 1 depicting the pressure compensator 112 and sensing unit 108 in greater detail. The sensing unit 108 is depicted as including a sensor housing 214 with electrodes (or wellbore sensors) 217 for taking downhole measurements. The sensor housing 214 may be positioned in various parts of the downhole tool 104, such as housing, arms, pads, etc. (as shown in FIG. 1).

In this illustrative example, the pressure compensator 112 includes two pressure compensation sections, i.e., a first pressure compensation section 216 and a second pressure compensation section 218. It should be appreciated that the pressure compensator 112 may include one or more pressure compensation sections. The first pressure compensation section 216 is fluidly exposed to a wellbore fluid 111, such as oil-based mud, water-based mud, or other downhole fluid, in the wellbore 106. The first pressure compensation section 216 includes a first pressure regulation section 220 and a compensating fluid section 222. The first pressure regulation section 220 includes a cylinder 224 with a first pressure regulating device, such as a piston 226 slidably positionable therein to define a wellbore fluid cavity 228 and a compensating fluid cavity 230. The piston 226 may be provided with a seal (or gasket) 232 to prevent the passage of fluid between the wellbore fluid cavity 228 and the compensating fluid cavity 230, and a spring 234 having a spring tension configured to apply an overpressure $\Delta P_1$ as it translates a wellbore pressure $P_{wb}$ of the wellbore fluid 111 received in the wellbore fluid cavity 228 to a compensation pressure $P_c$ of a first compensating fluid 238 in the compensating fluid cavity 230.

The compensating fluid cavity 230 is in fluid communication with the compensating fluid section 222 via flowline 240 for passing the first compensating fluid 238 therebetween. The compensating fluid section 222 may be fluidly coupled to one or more second pressure compensation sections 218 via flowline(s) 242. For descriptive purposes, only one second pressure compensation section 218 is depicted. While flowlines 240, 242 may be depicted as a tube or hose, the second pressure compensation section 218 may optionally be directly coupled to the compensating fluid cavity 230. In cases where flowlines are provided, the first and/or second pressure compensation sections 216, 218 may be movable, for example, where positioned in moving parts, such as sensor pads extendable by arms (see, e.g., 109 of FIG. 1).

Referring still to FIG. 2, the second pressure compensation section 218 may be a separate component coupled to the sensor 217 (e.g., pressure, temperature, or other gauge) or a measuring pad for measuring downhole parameters, or may be formed as an integral part of the sensor or the measuring pad. The second pressure compensation section 218 also includes a pressure regulation section 244 that has a second pressure regulating device, such as a membrane 246 flexibly positionable in the sensor housing 214 and defining a first compensating fluid cavity 248 and a second compensating fluid cavity (or section) 250. A seal 258 may be provided about the membrane 246 to further prevent fluid passage between the first compensating fluid cavity 248 and the second compensating fluid cavity 250. The membrane 246 may be made of an elastomeric, metallic or other flexible material to prevent the passage of fluid. The second pressure regulating device (e.g., membrane 246) applies an overpressure $\Delta P_2$ while allowing the compensation pressure $P_c$ of the first compensating fluid 238 in the first compensating fluid cavity 248 to apply to a sensor pressure $P_s$ of a second compensating fluid 252 in the second compensating fluid cavity 250.

The second pressure compensation section 218 may also be provided with a sensing device 254, such as a piston, for evaluating the position of the membrane 246. One or more sensing devices 254 may be provided about the pressure compensator 112 to determine operation of one or more pressure regulating devices. The sensing device(s) 254 may be used to determine, for example, the longitudinal displacement of the piston 226 and/or the expansion/retraction position of the membrane 246. The sensing device(s) 254 may be, for example, a capacitive/resistive measurement sensor for continuous position information, or a switch for discrete position information.

A disconnect 256 may also be provided in the sensor housing 214 for selectively disconnecting the second pressure compensation section 218 from the first pressure compensation section 216. The disconnect 256 may have a switch to detect if the second pressure compensation section 218 is intentionally or unintentionally disconnected from the first pressure compensation section 216. The switch may prevent the first compensating fluid 238 from flowing out and/or impairing the functioning of other portions of the pressure compensator 112 and/or the downhole tool 104. This disconnect switch may be, for example, a mechanical contact self-closing valve or a mechanical check valve.

Plugs 260 may also be provided in the sensor housing 214 for selectively permitting addition or removal of fluids. The plugs 260 may be, for example, fill/empty plugs added to various portions of the second pressure compensation section 218 or other portions of the pressure compensator 112 for filling and/or emptying fluids.

As shown in FIG. 2, the pressure regulation sections 220, 244, and the compensating fluid sections 222, 250 are in fluid communication for regulating pressure therebetween. For example, the wellbore pressure $P_{wb}$ balances with the compensation pressure $P_c$ of the first compensating fluid 238 and the sensor pressure $P_s$ of the second compensating fluid 252. The first pressure regulation section 220 provides a first interface in direct contact with the wellbore fluid 111, and the second pressure regulation section 244 provides a second interface indirectly providing pressure communication between the sensor 217 and the wellbore fluid 111. In this manner, the pressure compensator 112 provides a compensation chain that enables the wellbore pressure $P_{wb}$ to be indirectly applied to the wellbore sensor 217.

The first compensating fluid 238 and the second compensating fluid 252 may be any suitable fluids or media, such as oil (e.g., dielectric, silicon, mineral or other oil), gel, foam, non-conducting fluids, etc. For example, such fluid may be a liquid with good lubrication properties, low expansion/compression set towards temperature/pressure, and any other desired properties to facilitate operation of the pressure compensator 112 and/or the sensing unit 108 (e.g., power transmission for a hydraulic circuit, good insulation, purity, etc.) In some cases, the compensating fluid may be different from the hydraulic oil or other fluids used in the downhole tool 104.

The pressure regulation section(s) 220 and/or 244 may be provided with any suitable pressure regulating device (e.g., a piston, bellows, membrane, etc.) capable of providing a tight barrier between the wellbore fluid 111 and the first compensating fluid 238 and/or between the first compensating fluid 238 and the second compensating fluid 252, while allowing movement in response to the fluid(s) and regulating pressure therebetween. The pressure regulating devices are preferably gas tight to avoid fluid/solid/gas entry in and/or out of such devices. The pressure regulating devices may have static or dynamic seals 232, 258, such as welded/soldered membranes, gaskets, elastomers, etc. By way of example, when the pressure and/or temperature vary, the pressure and/or temperature may expand and/or retract the compensating fluids 238, 252. The pressures $P_{wb}$, $P_c$, $P_s$ may be in a range of from about 1 to about 3000 bar (about 0.1 MPa to about 300 MPa), the overpressures $\Delta P_1$, $\Delta P_2$ may be in the range of from about 1 to about 10 bar (about 0.1 to about 1 MPa), and/or the temperature may be in a range of from about −50 to about 250 degrees C.

Figure 3A:
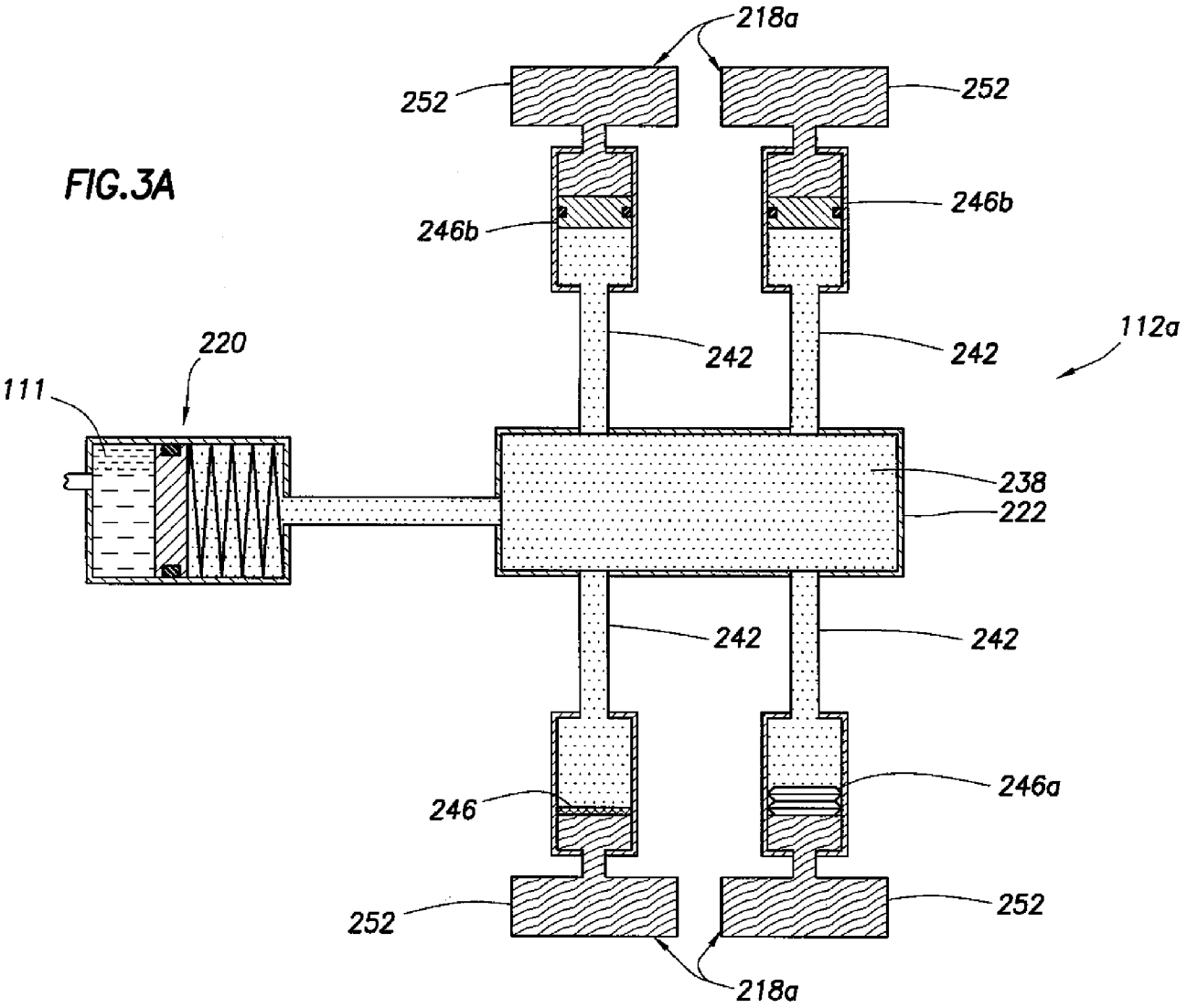
FIG. 3A is a schematic view of a pressure compensator having indirect interfaces.
Figure 3B:
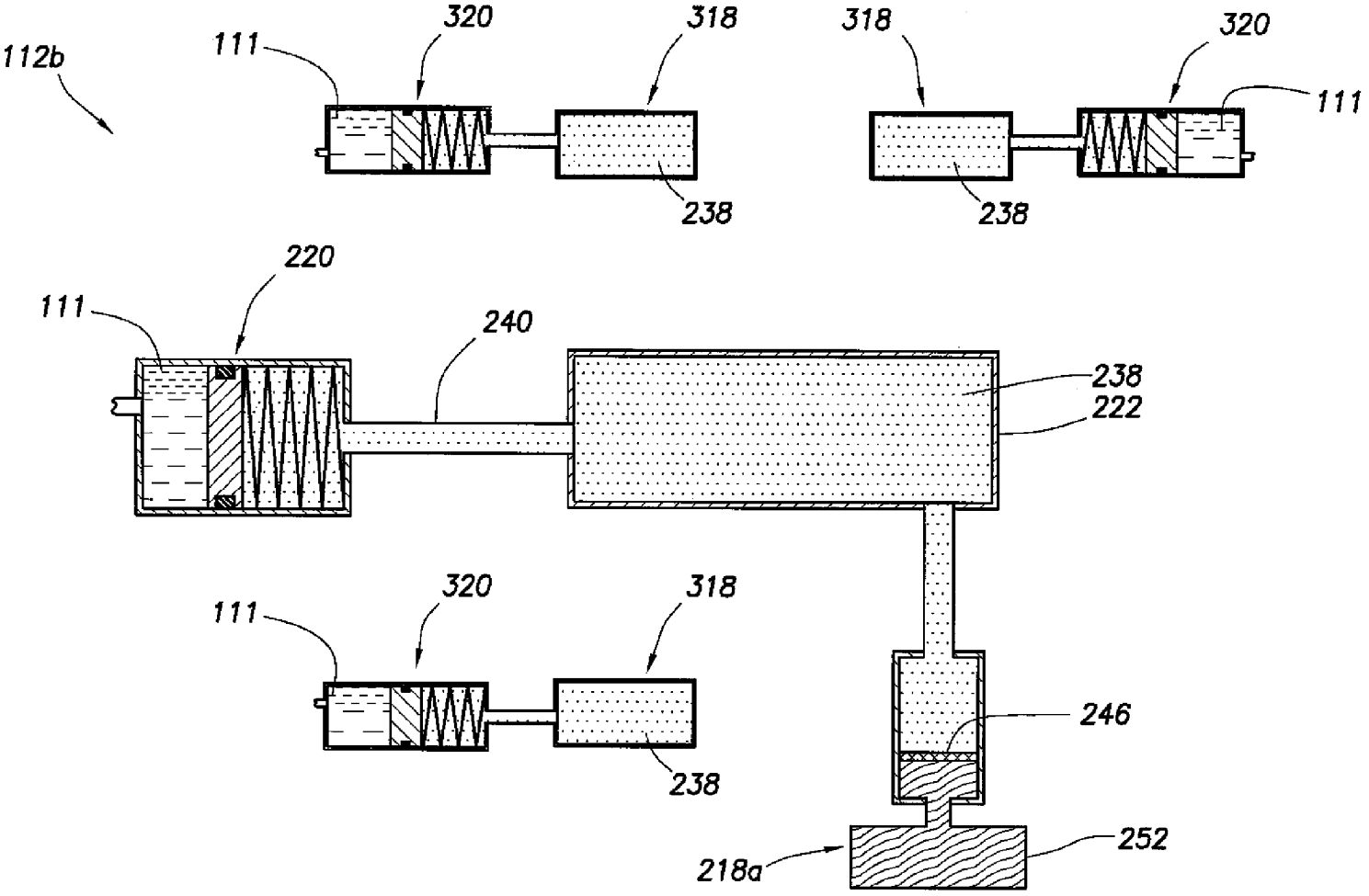
FIG. 3B is a schematic view of a pressure compensator having direct and indirect interfaces.

FIGS. 3A and 3B schematically depict various configurations of a pressure compensator 112*a*,112*b*, respectively, usable as the pressure compensator 112 of FIG. 1 or 2. The pressure compensator 112*a* of FIG. 3A has multiple second pressure compensation sections 218*a* with an indirect interface configuration for compensating the pressure of the wellbore fluid 111. The pressure compensator 112*a* is similar to the pressure compensator 112 of FIG. 2, except that multiple pressure compensation sections 218*a* are depicted as being linked to the compensating fluid section 222 by flowlines 242, and that various pressure regulating devices 246, 246*a*, 246*b* are depicted. The pressure compensation sections 218*a* of FIG. 3A include a membrane 246, bellows 246*a*, and piston 246*b* as the second pressure regulating device for transferring the pressure $P_c$ of the first compensating fluid 238 to the second compensating fluid 252. As demonstrated by this figure, the pressure regulating device may be any device, such as a membrane 246, bellows 246*a*, piston 246*b*, or other device capable of regulating pressure between fluids.

In the indirect interface configuration of FIG. 3A, each second pressure compensation section 218*a* has its own second pressure regulating device 246, 246*a*, or 246*b* with its own second compensating fluid 252 for providing its own individual pressure compensation system. Each of these individual indirect interfaces is coupled to the shared first compensating fluid 238 of compensating fluid section 222. This configuration allows each pressure compensation section 218*a* to have pressure communication with the wellbore fluid 111 through the shared first compensation fluid 238. This provides a single interface between the wellbore fluid 111 and multiple second pressure compensation sections 218*a*.

The pressure compensator 112*b* of FIG. 3B provides multiple pressure compensation sections 320, 218*a* with a combined direct and indirect interface configuration for compensating the pressure of the wellbore fluid 111. The pressure compensator 112*b* is similar to the pressure compensator 112*a* of FIG. 3A, except that three of the pressure compensation sections are depicted as a third (or direct) pressure compensation section 320 with a direct interface with the wellbore fluid 111, and one of the pressure compensation sections is depicted as a second pressure compensation section 218*a* with an indirect configuration with an indirect interface with the wellbore fluid 111. The second pressure compensation section 218*a* has a pressure regulating device 246, such as a membrane, coupled to the compensating fluid section 222 as previously described for FIG. 3A. As demonstrated by this figure, the pressure compensator 112*b* may have one or more direct interfaces and one or more indirect interfaces with the wellbore fluid 111.

The combined direct and indirect configuration of FIG. 3B allows each of the third pressure compensation sections 320 to have individual pressure communication with the wellbore fluid 111, and a fluid compensation section 318. Each of the third pressure compensation sections 320 has a third pressure regulation device and is similar to the pressure regulation device 226 previously described herein, except that the first compensating fluid 238 in the fluid compensation section 318 is exposed directly to a sensor for applying the wellbore pressure directly thereto.

A separate first pressure regulation section 220 is also depicted for indirectly providing pressure compensation to various portions of the downhole tool, such as for second pressure compensation section 218*a*. One or more pressure compensation sections 218, 218*a*, 318 may be provided in various configurations as desired. Redundant pressure compensation sections may be used, for example, in case certain pressure compensation sections are affected by exposure to wellbore fluids or otherwise malfunction.

Referring to FIGS. 1-3B, in operation, the pressure compensator 112, 112*a*, 112*b* adjusts pressure to in situ conditions. Wellbore fluid (e.g., mud) 111 surrounds the downhole tool 104, the sensing unit 108 and the pressure compensator 112. The wellbore fluid 111 has a pressure $P_{wb}$. This wellbore pressure $P_{wb}$ may vary with the movement of the downhole tool 104 in the wellbore and/or variations in the wellbore pressure $P_{wb}$.

The wellbore fluid 111 enters the first pressure regulation section 220 and applies pressure $P_{wb}$ to the first pressure regulation device (e.g., piston) 226. The wellbore pressure $P_{wb}$ applied to the piston 226 may compress the spring 234 and translate the pressure to the first compensation fluid 238. The spring 234 ensures a positive displacement of the piston 226 and the seal 232, and adds an overpressure $\Delta P_1$ inside the first compensating fluid 238. This overpressure $\Delta P_1$ may be used to avoid wellbore fluid 111 entry through the first pressure regulation section 220 if potential leaks occur at the seal 232. The compensation pressure $P_c$ of the first compensating fluid 238 may be determined by the following Equation (1):

$$P_c = P_{wb} + \Delta P_1 \quad \text{(Equation 1)}$$

The first compensating fluid 238 is communicated to all second pressure compensation sections 218, 218*a* via flowlines 242 (or directly where no flowlines are present). The first compensating fluid 238 and the second compensating fluid 252 are isolated by the second pressure regulation device 246 with a seal 258 to avoid fluid transfer therebetween. The second pressure regulation device 246 allows for transmission of the compensating pressure $P_c$ of the first compensating fluid 238 to the sensor pressure $P_s$ of the second compensating fluid 252. The second pressure regulation device 246 has a resilience which adds an overpressure $\Delta P_2$ from the first compensating fluid 238 to the second compensating fluid 252. The sensor pressure $P_s$ of the second compensating fluid 252 may be determined by the following Equation (2):

$$P_s = P_c + \Delta P_2 \quad \text{(Equation 2)}$$

From Equations (1) and (2), the following Equation (3) may be derived:

$$P_s = P_m + \Delta P_1 + \Delta P_2 \quad \text{(Equation 3)}$$

The first pressure regulation section 220 and the second pressure regulation section 244 may allow some positive or negative movement of the pressure regulation device 226, 246 itself. For example, the first pressure regulation device 226 may translate longitudinally inside its cylinder 224 or the second pressure regulation device 246 may expand or retract similar to a balloon. This movement may allow the first and/or second pressure regulation section 220, 244 to adapt for fluid volume changes due to pressure and/or temperature changes (e.g., expansion, contraction or other changes, such as small leaks to a certain point).

As shown in FIG. 2, the pressure regulation devices 226, 246 are positioned in a central (or released) position at ambient pressure and/or ambient temperature. Higher temperatures may cause the first compensation fluid 238 and the second compensation fluid 252 to expand, thereby causing pressure regulation devices 226,246 to move to an extended position. The first pressure regulation device 226 is in the extended position as it advances to expand the compensation fluid cavity 230. The second pressure regulation device 246 is moved to the extended position as it expands to enlarge the second compensating fluid cavity (or section) 250.

Higher pressures may cause the first compensation fluid 238 and the second compensating fluid 252 to retract, thereby causing the first pressure regulation device 226 and the second pressure regulation device 246 to move to a refracted position. The first pressure regulation device 226 is in the retracted position as it moves to reduce the compensating fluid cavity 230. The second pressure regulation device 252 is moved to the retracted position as it deflates to reduce the second compensating fluid cavity (or section) 250.

The sensing device 254 may be used to determine the position of the second pressure regulation device 246. If the second pressure regulation device 246 and the first pressure regulation device 226 move together, the position of the first pressure regulation device 226 may also be determined accordingly. This information may be used, for example, to detect failures or to know when refills may be necessary for the first compensating fluid 238 and/or the second compensating fluid 252. This information may also be used to determine, for example, a measurement of the position of one or more of the second pressure regulation devices 246 to determine the different volumes of first compensating fluid 238.

Pressure may also be compensated through the third pressure compensation sections 320. The amount of first compensating fluid 238 may be used to evaluate maintenance needs and/or refill needs. Information gathered by the pressure compensator 112 and/or the sensing unit 108 may be passed to a surface unit (not shown).

Figure 4:
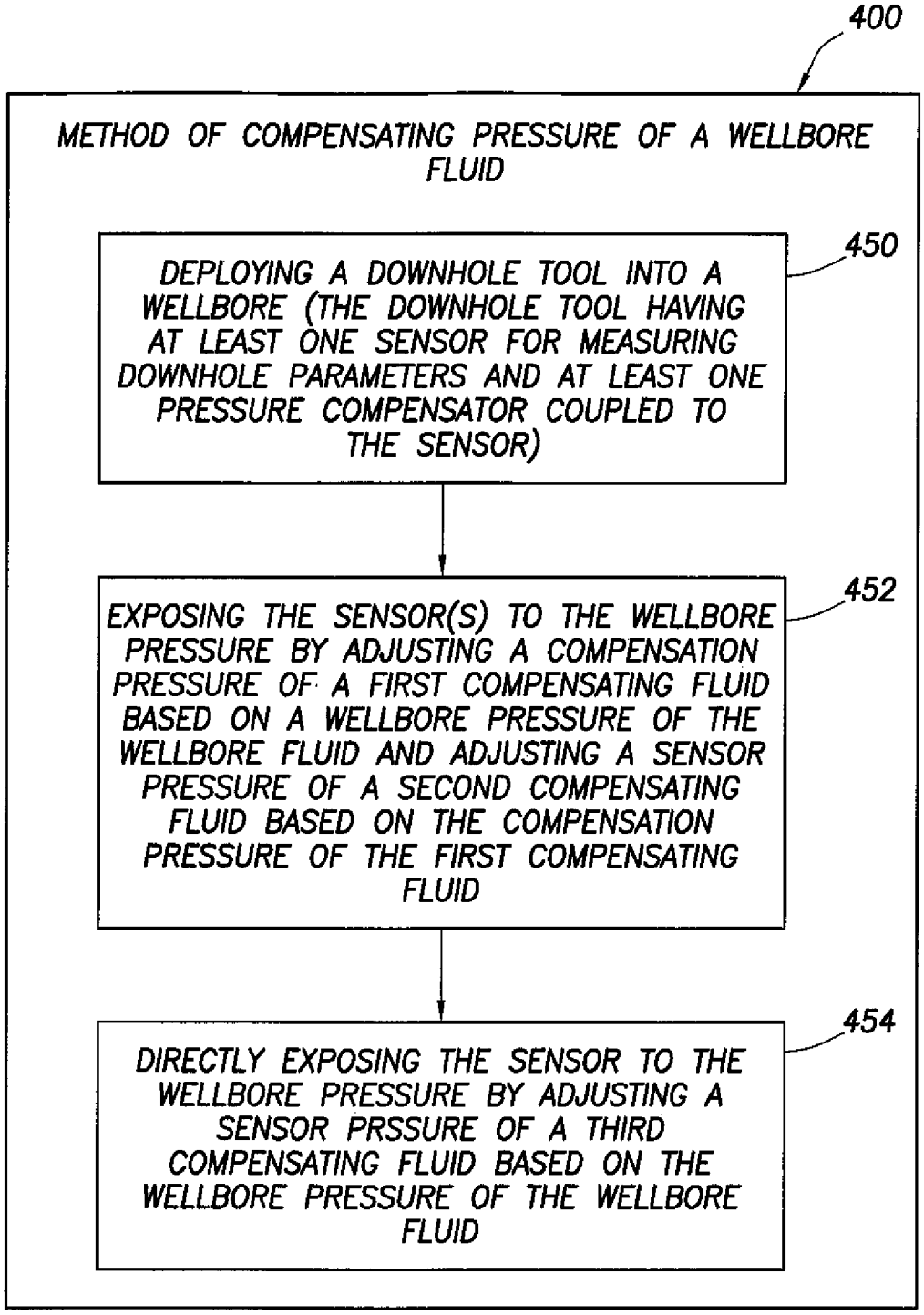
FIG. 4 is a flow chart depicting a method of compensating pressure of a sensor of a downhole tool.

FIG. 4 depicts a method 400 of compensating pressure of a wellbore fluid. The method involves deploying (450) a downhole tool into a wellbore (the downhole tool having at least one sensor for measuring downhole parameters and at least one pressure compensator coupled to the sensor), and exposing (452) the sensor(s) to a wellbore pressure of the wellbore fluid by adjusting a compensation pressure of a first compensating fluid based on the wellbore pressure and adjusting a sensor pressure of a second compensating fluid based on the compensation pressure of the first compensating fluid. The method may also involve directly exposing (454) the sensor to the wellbore pressure by adjusting a sensor pressure of a third compensating fluid based on the wellbore pressure of the wellbore fluid.

While the embodiments are described with reference to various implementations and exploitations, it will be understood that these embodiments are illustrative and that the scope of the inventive subject matter is not limited to them. Many variations, modifications, additions and improvements are possible. For example, one or more sensing units may be positioned about various portions of the downhole tool and have one or more direct or indirect compensation units operatively coupled thereto for compensating for pressure thereabout.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A pressure compensation system for at least one sensor positionable in a wellbore penetrating a subterranean formation, the wellbore having a wellbore fluid therein, comprising:

a downhole tool positionable in the wellbore, the downhole tool comprising the at least one sensor; and at least one pressure compensator positionable in the downhole tool, comprising:

a first compensating fluid section having a first compensating fluid therein;

a first pressure compensation section in pressure communication with the wellbore fluid and the first compensating fluid section, the first pressure compensation section having a first pressure regulation device separating the wellbore fluid from the first compensating fluid and for adjusting a compensation pressure of the first compensating fluid based on a wellbore pressure of the wellbore fluid;

at least one second compensating fluid section having a second compensating fluid therein, the second compensating fluid is in contact with the at least one sensor;

at least one second pressure compensation section in pressure communication with the first compensating fluid section and the at least one second compensating fluid section, the at least one second pressure compensation section having a second pressure regulation device separating the first compensating fluid from the second compensating fluid and for adjusting a sensor pressure of the second compensating fluid based on the compensation pressure of the first compensating fluid;

at least one third compensating fluid section having a third compensating fluid therein, the third compensating fluid is in contact with the at least one sensor, and at least one third pressure compensation section in pressure communication with the wellbore fluid and the at least one third compensating fluid section, the at least one third pressure compensation section having a third pressure regulation device separating the wellbore fluid from the third compensating fluid and for adjusting a sensor pressure of the third compensating fluid based on the wellbore pressure of the wellbore fluid.

2. The system of claim 1, wherein the first and second pressure regulation devices each comprises one of a piston, a membrane, a bellows and combinations thereof.

3. The system of claim 1, wherein the first pressure regulation device comprises a spring loaded piston.

4. The system of claim 1, wherein the first and second pressure regulation devices each comprises at least one seal for restricting the flow of fluid therethrough.

5. The system of claim 1, wherein the at least one second pressure compensation section is fluidly coupled to the first compensating fluid section by a flowline.

6. The system of claim 1, wherein the first pressure compensation section is fluidly coupled to the first compensating fluid section by a flowline.

7. The system of claim 1, further comprising at least one sensing device for determining a position of one of the first pressure regulation device, the second pressure regulation device, and combinations thereof.

8. The system of claim 1, further comprising a disconnect for selectively detaching the at least one second pressure compensation section from the first compensating fluid section.

9. The system of claim 1, further comprising at least one plug for selectively accessing one of the first compensating fluid, the second compensating fluid and combinations thereof.

10. The system of claim 1, wherein the compensation pressure of the first compensating fluid includes an overpressure with respect to the wellbore pressure.

11. The system of claim 1, wherein the sensor pressure of the second compensating fluid includes an overpressure with respect to the compensation pressure of the first compensating fluid.

12. The system of claim 1, wherein the downhole tool is one of a drilling tool, coiled tubing tool, testing tool, measurement while drilling tool, logging while drilling tool, wireline tool and combinations thereof.

13. A method of compensating pressure for at least one sensor positionable in a wellbore penetrating a subterranean formation, the wellbore having a wellbore fluid therein, comprising:

deploying a downhole tool into the wellbore, the downhole tool having a pressure compensator operatively connected to the at least one sensor, the pressure compensator comprising:

a first compensating fluid section having a first compensating fluid therein;

a first pressure compensation section in pressure communication with the wellbore fluid and the first compensating fluid section, the first pressure compensation section having a first pressure regulation device separating the wellbore fluid from the first compensating fluid;

at least one second compensating fluid section having a second compensating fluid therein, the second compensating fluid is in contact with the at least one sensor;

at least one second pressure compensation section in pressure communication with the first compensating fluid section and the at least one second compensating fluid section, the at least one second pressure compensation section having a second pressure regulation device separating the first compensating fluid from the second compensating fluid;

at least one third compensating fluid section having a third compensating fluid therein, the third compensating fluid is in contact with the at least one sensor; and at least one third pressure compensation section in pressure communication with the wellbore fluid and the at least one third compensating fluid section, the at least one third pressure compensation section having a third pressure regulation device separating the wellbore fluid from the third compensating fluid; and exposing the at least one sensor to a wellbore pressure of the wellbore fluid by adjusting a compensation pressure of the first compensating fluid based on the wellbore pressure and adjusting a sensor pressure of the second compensating fluid based on the compensation pressure of the first compensating fluid.

14. The method of claim 13, wherein the method further comprises: exposing the at least one sensor to the wellbore pressure by adjusting a sensor pressure of the third compensating fluid based on the wellbore pressure of the wellbore fluid.

* * * * *